US005323909A

United States Patent [19]

Piraneo et al.

[11] Patent Number: 5,323,909

[45] Date of Patent: Jun. 28, 1994

[54] STACKABLE BAG WITH BREAKAWAY SUSPENSIONS

[75] Inventors: Carmelo Piraneo, Redondo Beach; Salim S. Bana, Orange; Jonathan Karp, Pacific Palisades, all of Calif.

[73] Assignee: Orange Plastics, Inc., Compton, Calif.

[21] Appl. No.: 875,349

[22] Filed: Apr. 29, 1992

[51] Int. Cl.[5] ..... B65D 33/14

[52] U.S. Cl. ..... 206/554; 383/903

[58] Field of Search ..... 206/554; 383/903; 248/692, 100; 211/57.1

[56] References Cited

U.S. PATENT DOCUMENTS

| | | | |
|---|---|---|---|
| 3,198,325 | 8/1965 | White | 206/554 |
| 3,493,166 | 2/1970 | Smith et al. | 383/903 |
| 4,529,090 | 7/1985 | Pilon | 383/903 |
| 4,785,938 | 11/1988 | Benoit, Jr. et al. | 206/554 |
| 4,981,216 | 1/1991 | Wilfong, Jr. | 248/100 |
| 5,074,674 | 12/1991 | Kuklies et al. | 206/554 |

*Primary Examiner*—Stephen P. Garbe

*Attorney, Agent, or Firm*—Sheldon & Mak

[57] ABSTRACT

A system for supporting and dispensing thermoplastic, rack-mounted handle bags is disclosed, including an adapter hook, a support rack having a centrally disposed retainer, and laterally spaced, outward protruding suspension arms. The adapter hook includes a base member with a hook extending perpendicular therefrom, and is designed to slip over the retainer. Also disclosed are handle bags, which are suspended by the suspension arms and adapter hook, each bag including a protruding area in a front bag wall and a rear bag wall. A horizontal aperture in each bag wall at the protruding area provides an opening through which the adapter hook passes. To facilitate detachment of the protruding area from the adapter hook, a series of vertical perforations is incorporated into the protruding area extending from the horizontal aperture up to the edge of the protruding area. To further promote tearing, a distal end of the hook is configured to have a width narrower than the horizontal aperture thus concentrating tearing stress onto the perforations.

7 Claims, 1 Drawing Sheet

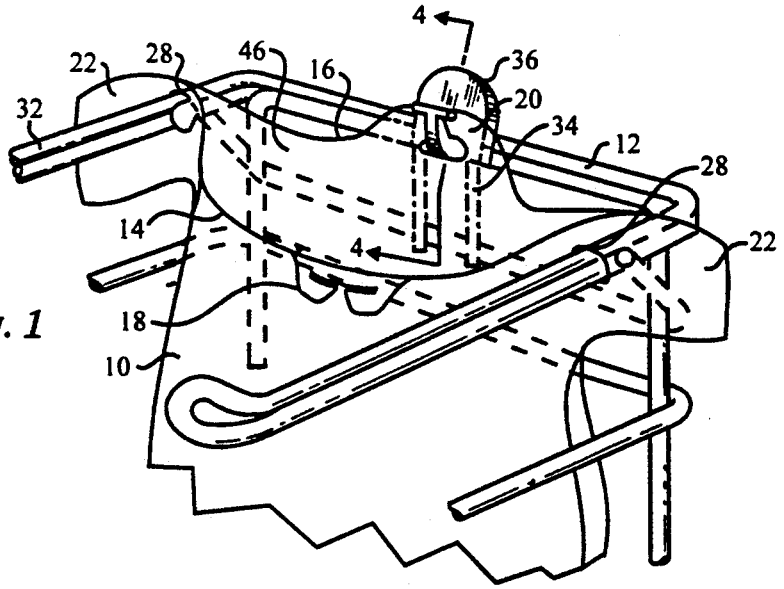
Fig. 1
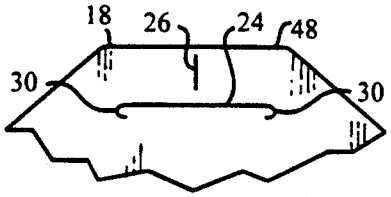
Fig. 2
Fig. 3
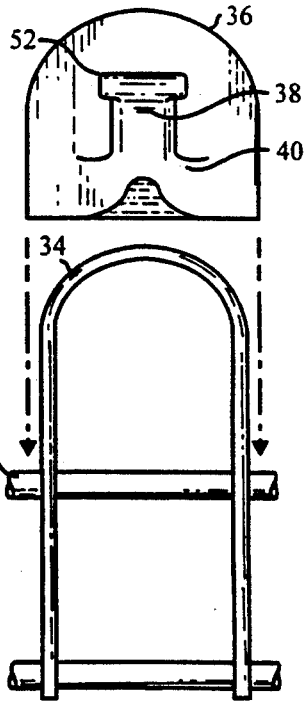
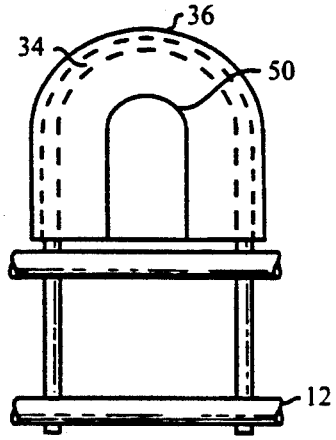
Fig. 5
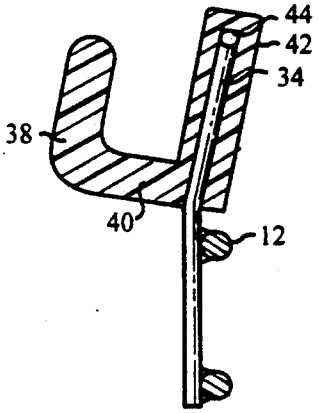
Fig. 4

STACKABLE BAG WITH BREAKAWAY SUSPENSIONS

BACKGROUND OF THE INVENTION (1) Field of the Invention

The present invention relates to stackable bags and a system for dispensing stackable bags. More precisely, the present invention relates to a system for dispensing stackable handle bags using a hook adapter and a breakaway protruding area integral with the front and rear bag walls, and to stackable, breakaway bags useful in said system.

(2) Described of the Related Art

As everyone has seen when he or she passes through a grocery or discount store check-out line, there is a box boy or grocery bagger who loads the groceries into a bag, which is usually made from paper or plastic. For convenience of the customer and efficiency of the business, this bagging operation is performed as quickly as possible with very little wasted motion.

Many different methods have been devised to simplify yet expedite the procedure of filling the bag with goods or groceries. Currently, the grocery bags found in many stores arrive at the store in neatly stacked bundles called bag packs. The bag pack is composed of individual bags uniformly stacked into a single pack and held together with small pin welds.

As found in most stores, to complement the bag pack, a metal wire rack having two laterally spaced apart outward extending support arms is used to suspended the bag pack. At the end of a check-out line, the grocery bagger stands over the rack-mounted bag pack, and dispenses and fills the bags, one at a time.

Each stackable bag in the bag pack is a bag, optionally having pleated sides or bottom, with an open top and upward extending handles. Often times, this sort of bag is described as a t-shirt bag because its appearance is reminiscent of its namesake. Toward the center of the bag opening, between the handles, there is usually a tab with a horizontal aperture cut therein. The tab, by way of the horizontal aperture, is suspended from a center retaining hook located on the rack. After the bag is loaded, the grocery bagger slides the bag handles off of the outward projecting arms which previously suspended them, and detaches the bag from the tab to release the bag from the rack. The individual pin welds are easily separated with only slight tugging. Such a bag pack dispensing system is disclosed in U.S. Reissue Pat. No. RE 33,264 to Baxley et al.

The Baxley system, however, has a drawback, namely, the remnant tabs, left on the rack after each bag is detached, accumulates and must be promptly removed. U.S. Pat. No. 4,877,473 to Snowdon et al. discloses a similar rack mounted plastic bag using a tab, and likewise has the same problem as Baxley, et al.

In a different approach, bag designers have done away with the central tab near the opening and alternatively rely on perforated tabs located in the handle portion. Such a bag is disclosed in U.S. Pat. No. 4,759,639 to DeMatters. Such a bag still has a residue problem in that the tabs detached from the handles remain on the suspension arms of the rack.

U.S. Pat. No. 5,074,674 to Kuklies et al. discloses a bag incorporating another approach to solving the residue tab problem of the prior art. Kuklies shows a rack-mounted bag having horizontal apertures located near the top edge of the rear bag wall, and upwardly extending handles. The bags are suspended by the handles from a rack and by a centrally located hook on the rack which latches on to only the rear bag wall via the horizontal aperture. In fact, the front bag wall of the Kuklies bag is not suspended at all.

As a result, in use, the front bag wall need not be detached from the centrally located hook of the rack. According to the disclosure, it has been seen that in this system the front bag wall, if attached, causes binding and separation problems at the point of attachment around the hook. Hence the Kuklies bag does not have the front bag wall suspended from the hook.

Accordingly, a need presently exists for a rack-mounted, stackable bag that can be individually detached from the stack and rack without leaving remnants on the rack. Detaching each bag from the pack should also be performed without complication and wasted motion.

SUMMARY OF THE INVENTION

The present invention provides a stackable handle bag system for dispensing stacked handle bags individually while suspended from a rack.

As part of the system, the present invention provides a stackable handle bag, adaptable for mounting on the above-mentioned rack. In the preferred embodiment, the handle bag comprises a front bag wall joining a rear bag wall, together defining an enclosure. Near the center of each bag wall at the opening is a protruding area that is integral with the bag wall. On each bag wall, on either side of the protruding area are upwardly extending handles that arch over the opening and connect with the opposing bag wall.

In each protruding area is a horizontal aperture. The horizontal aperture in the front bag wall is aligned with the horizontal aperture of the rear bag wall. A series of perforations extends vertically from the horizontal aperture up to the edge of the protruding area. The perforations are designed to separate or tear under stress.

Handle apertures are provided in each handle and designed to receive the suspension arms extending from the rack. Thus, the present invention bag is suspended from the rack by both handles on the suspension arms and by its protruding areas.

The rack, although not forming part of the invention, is described in the following as background information. At the top of the rack are twin outward extending, laterally-spaced parallel suspension arms used to suspend the handle bags. Centrally located on the rack is a D-ring used to support the central area of the handle bag. Racks of the described configuration are commonly found in grocery stores or department stores. Accordingly, the present invention is adapted to function in harmony with such racks.

In regard to suspending the protruding areas, the present invention provides a special adapter hook designed to pass through and latch the horizontal aperture. Generally speaking, the hook adapter is comprised of a hook projecting at right angles from a base member. A cavity, formed inside the base member and open to the exterior, is intended to receive a D-ring retainer of the rack when the former is slid over the latter.

The D-ring retainer is commonly found on all pre-existing racks. It is used to suspend the central area of the bag pack. A distal end of the hook is narrow in comparison to the width of the aperture in the protruding area. Thus, the narrow distal end reduces the area of contact with the protruding area of the handle bag. The D-ring engages the horizontal aperture of the handle bag at opposite extremes of the aperture, thereby not focusing tearing stress onto a concentrated area near the perforations. On the other hand, with the adapter hook of the present invention covering the D-ring, the narrow width of the distal end of the hook focuses stress to a precise position on the protruding area to cause tearing at the perforations.

In accordance with the present invention, the adapter hook is slipped over the D-ring of the rack before the handle bags are mounted thereon. As is known in the art, the handle bags are stacked uniformly so that adjacent apertures are aligned. Furthermore, as is known in the art, small pin welds are used to help maintain the individual bags in alignment.

During use after mounting the bag pack to the rack, a grocery bagger simply slides the front bag wall toward him thus separating one bag from the stack. Each handle slides forward along the suspension arms of the rack. As required, either the front bag wall or both the front bag wall and the rear bag wall can be detached from the adapter hook by a simple downward tug. This motion pulls the protruding area against the adapter hook placing stress along the vertical perforations. Consequently, the stress causes a tear which propagates along the vertical perforations separating the protruding areas of both the front bag wall and the rear bag wall, releasing the central protruding areas of the bag from the adapter hook. Although the protruding area splits at the vertical perforations, the outlying regions of the protruding area remain attached to the bag. Thus, as the bag is detached from the adapter hook, all material detaches therewith and no remnant material is left on the rack.

Moreover, since the preferred embodiment of the present invention bag is injection molded from a thermoplastic material, and is stretched to obtain its form, the molecular grain structure of the material is affected so that tears in the bag tend to run vertically. This is a tendency inherent in the material by virtue of its method of manufacture. On the other hand, tearing in the transverse direction along the horizontal aperture is not likely due to the same molecular grain structure formed during the manufacture of the bag.

As a precaution, however, in an alternative embodiment, the present invention provides a second horizontal slit beneath the horizontal aperture to intercept vertical propagation of errant tears. In another alternative embodiment, the present invention can have pleated sides or a pleated bottom.

It is therefore an object of the present invention to provide a rack-mountable bag that when detached from the rack does not leave behind any remnant material. It is another object of the present invention to provide a bag that is supported at a central location near the opening on both the front and rear bag walls to assure proper deployment of the bag without binding or unwanted detachment of the bag wall. It is yet another object of the present invention to provide an adapter hook designed to cover a D-ring retainer commonly found on store racks, wherein the adapter hook directs tearing stress onto a suspension area on the bag.

BRIEF DESCRIPTION OF THE DRAWINGS

FIG. 1 is a partial perspective view of the present invention showing a preferred embodiment bag as disposed on a rack with a preferred embodiment adapter hook.

FIG. 2 is a partial detailed view of a first protruding area of the bag.

FIG. 3 is a front view of the adapter hook before attachment to a D-ring retainer of the rack.

FIG. 4 is a sectional view of the adapter hook and D-ring taken along line 4—4 of FIG. 1.

FIG. 5 is a back elevational view of the adapter hook as attached to the D-ring retainer of the rack.

DETAILED DESCRIPTION OF THE INVENTION

In the following description, numerous details such as specific materials and configurations are set forth in order to provide a more complete understanding of the present invention but it is understood by those skilled in the art that the present invention can be practiced without those specific details. In other instances, well-known elements are not described explicitly so as not to obscure the invention.

The present invention relates to a stackable handle bag and adapter hook system wherein the two, if used in conjunction with a rack, provide a mechanism to dispense handle bags from a bag stack quickly, efficiently, and with little waste. FIG. 1 shows a preferred embodiment of the present invention. Although the present invention is directed to a stack of handle bags, FIG. 1 illustrates a single bag for the sake of clarity. As shown in the drawing, a handle bag 10 is suspended on a rack 12. The rack 12, as s known in the art, is typically comprised of a metal wire frame having twin outward projecting suspension arms 32. Since the rack 12 is well-known in the art and does not form a part of the present invention, no further discussion regarding its structure is necessary.

As shown in FIG. 1, the handle bag 10 comprises a front bag wall 14 joined to a rear bag wall 16 to form an enclosure having an open top 46. On the front bag wall 14 is a first protruding area 18; likewise, on the rear bag wall 16 is a second protruding area 20. The protruding areas 18, 20 can be described as extensions in the wall material. As the handle bag appellation suggests, the present invention bag 10 has carrying handles 22 that are disposed on either side of the opening 46 and rise upward. Each handle 22 has a handle aperture 28 so that the handles 22 can easily engage the suspension arms 32 of the rack 12.

FIG. 2 provides an enlarged, partial view of the first protruding area 18. A short distance down from the opening edge of the bag 10 is a horizontal aperture 24. Extending vertically and located between the horizontal aperture 24 and the open edge 48 is a series of perforations 26. Of course the perforations 26 can be replaced by a slit in an alternative embodiment. At opposite ends of the horizontal aperture 24 are arcuate ends 30. The arcuate ends 30 are optionally provided as a precaution to prevent the aperture 24 from tearing in a transverse direction. Importantly, the second protruding area 20 has the same features as the first protruding area 18.

With this combination of cuts in the protruding areas 18, 20, the present invention can cause tearing in the bag 10 along predetermined directions. In FIG. 1, the handle bag 10 is suspended by its handles 22 and by the protruding areas 18, 20. As already mentioned, the handles 22 are suspended by suspension arms 32 of the rack 12. On the other hand, the first and second protruding areas 18, 20 are suspended by an adapter hook 36. The adapter hook 36 passes through the horizontal aperture 24 of both the first and second protruding areas 18, 20 to support the front and rear bag walls 14, 16. In fact, the entire handle bag stack is supported at these three points. To use each bag, a grocery bagger simply tugs downward on the front bag wall forcing the first protruding area 18 downward against the adapter hook 36. Sufficient tugging causes the perforations 26 to separate, leading to a break in the material at the first protruding area 18. Accordingly, the first protruding area 18 along with the front bag wall 14 are released from the hook 36, as shown in FIG. 1. At this stage, the handles 22 are still supported by the suspension arms 32. Slight further pulling on the front bag wall 14 then opens the bag, and thereafter the grocery bagger can easily fill the interior. Once the bag 10 has been filled to capacity, the grocery bagger pulls the rear protruding area 20 away from the adapter hook 36 causing the same type of material break to release the second protruding area 20. The bag 10 through its handles 22 can then be slid off of the suspension arms 32. Apparent by now is the advantage of the present invention wherein no remnant material is left on the adapter hook 36 or the rack 12, as in prior art stackable handle bags.

The present invention provides the adapter hook 36 to ensure proper tearing in the protruding areas 18, 20. In particular, conventional racks 12 found in most discount or grocery stores have a D-ring retainer 34 as shown in FIGS. 1 and 3. The D-ring retainer 34 extends upwards and is centrally located on the rack 12. In the prior art, the handle bags are suspended at the central area on the D-ring retainer 34. The horizontal aperture through which the D-ring retainer 34 passes experiences stress at the ends of the aperture due to the width of the D-ring retainer 34. Because of the stress at the ends, unwanted tears often occur transversely and thus the handle bag does not detach properly.

In the present invention, however, to ensure proper tearing in the intended directions, the adapter hook 36 is used. The adapter hook 36, as shown in FIG. 4, has a cavity 44 disposed in its upright base member 42. The cavity 44 has an open bottom which allows the adapter hook 36 to be slipped over the D-ring retainer 34 as shown in FIG. 3. FIG. 5 provides a rear elevational view of the adapter hook 36 when it is properly positioned on the D-ring retainer 34. Preferably, there is an interference fit between the adapter hook cavity 44 and the D-ring retainer 34 to snugly hold the two parts together. Optionally, a finger hole cut out 50 is provided at the rear of the upright base member 44, shown in FIG. 5. The finger hole cut out 50 provides a way for the adapter hook 36 to be lifted off of the D-ring retainer 34.

As shown in FIGS. 1, 3 and 4, the adapter hook 36 has a projection joined to the upright base member 44 at its proximal end 40. The distal end 38 curves upward to form a hook. Notably, the distal end 38 is narrower than the proximal end 40. This shape focuses stress against the vertical perforations 26 when the protruding areas 18, 20 are pulled against the hook 36. Therefore, consistent and repeatable tearing along the vertical perforations 26 is assured.

Preferably, the distal end 38 of the adapter hook 36 includes an oversized tip 52. This tip 52 helps retain the protruding areas of a stack of bags together. Accordingly, the present invention adapter hook 36 is easily attached to preexisting racks found in most grocery stores and does not require any modification thereto. Because the adapter hook 36 simply slips over the D-ring retainer 34, converting conventional racks for use with the present invention bags is achieved quickly and economically.

Clearly, the hook adapter can be modified to have a variety of hook-like shapes and can be configured to attach to the D-ring retainer through a variety of attachment means known in the art. Preferably, the hook adapter is molded from a polymer.

Moreover, since the preferred embodiment of the present invention bag is injection molded from a thermoplastic material, and is stretched to obtain its form, the molecular grain structure of the material is affected so that tears in the bag tend to run vertically. This is a tendency inherent in the material by virtue of its method of manufacture. On the other hand, tearing in the transverse direction along the horizontal aperture is not likely due to the same molecular grain structure formed during the manufacture of the bag.

As a precaution, however, in an alternative embodiment as shown in FIG. 6, the present invention provides a second horizontal aperture 25 beneath the horizontal aperture to intercept vertical propagation of errant tears. In another alternative embodiment, the present invention can have pleated sides or a pleated bottom.

It should be recognized that the above-described invention may be embodied in other specific forms without departing from the spirit or essential characteristics of the disclosure. Thus, it is understood that the invention is not to be limited by the foregoing illustrative details.

What is claimed is:

1. A stackable handle bag system for dispensing stacked handle bags individually while suspended on a rack, the rack comprising a stand, two parallel, outward projecting, laterally spaced suspension arms, and a D-ring retainer centrally disposed in-between the suspension arms, the system comprising:

(a) a bag pack having a plurality of handle bags arranged uniformly in a stack, wherein each handle bag includes:

i) a front bag wall, ii) a rear bag wall joined opposite to the front bag wall defining an enclosure having an opening with an edge around the opening, iii) a first protruding area integral with the front bag wall formed centrally at the opening, iv) a second protruding area integral with the rear bag wall formed centrally at the opening, v) two handles integral with the front and rear bag walls upwardly extending from the opening adjacent the first and second protruding areas, each handle having a handle aperture disposed therein, vi) a horizontal aperture disposed in the first protruding area and int he second protruding area, and vii) a series of perforations extending from the horizontal aperture to the edge in the first protruding area and in the second protruding area, whereby all bags are substantially aligned in the stack such that adjacent horizontal apertures and adjacent handle apertures are substantially aligned; and (b) an adapter hook for clutching each handle bag, the adapter hook includes a base member mounted upon the D-ring retainer and a hook extending substantially perpendicular to the base member having a width less than the horizontal aperture, whereby the bag pack is suspended on the rack by the laterally spaced suspension arms passing through the handle apertures and by the adapter hook clutching the horizontal apertures of the front bag walls and rear bag walls enabling each bag to be individually removed from the stack by tearing the series of perforations against the adapter hook and sliding the handles off the suspension arms.

2. The stackable handle bag system according to claim 1, wherein the base member has a distal end that is narrower than a proximal end.

3. The stackable handle bag system of claim 1, wherein both horizontal apertures comprise at least one arcuate end to prevent transverse tearing of the horizontal apertures.

4. The stackable handle bag system of claim 1, wherein the handle bag further comprises pleated sides.

5. The stackable handle bag system of claim 1, wherein the handle bag is made from a thermoplastic material.

6. The stackable bag system of claim 1, wherein the series of perforations are aligned and extend vertically from a central location on the horizontal aperture.

7. The stackable bag system of claim 1, wherein the handle aperture further comprises a flap partially connected to the handle and co-extensive with the handle aperture.

* * * * *